US005481873A

United States Patent [19]

Saruwatari et al.

[11] Patent Number: 5,481,873

[45] Date of Patent: Jan. 9, 1996

[54] HYDRAULIC ACTUATING SYSTEM FOR A FLUID TRANSFER APPARATUS

[75] Inventors: Minoru Saruwatari; Kevin S. Saruwatari, both of Calgary; Fredrick A. Bourgonje, Dalmeny, all of Canada

[73] Assignee: Qsine Corporation Limited, Calgary, Canada

[21] Appl. No.: 341,416

[22] Filed: Nov. 17, 1994

[51] Int. Cl.[6] ..... F16D 31/02; F15B 11/00

[52] U.S. Cl. ..... 60/421; 60/428; 60/448; 60/452; 60/493; 91/518

[58] Field of Search ..... 91/361, 518; 60/420, 60/421, 372, 428, 426, 493, 494, 452, 448, 446, 451; 92/181 P

[56] References Cited

U.S. PATENT DOCUMENTS

| | | | |
|---|---|---|---|
| 3,782,117 | 1/1974 | James | 60/372 |
| 4,114,375 | 9/1978 | Saruwatari | 60/372 |
| 4,509,409 | 4/1985 | Reeves | 92/181 P X |
| 4,627,238 | 12/1986 | Mayr et al. | 60/452 |
| 4,848,085 | 7/1989 | Rosman | 60/372 |
| 4,991,672 | 2/1991 | Leino | 60/421 X |

FOREIGN PATENT DOCUMENTS 1032064 5/1978 Canada .

*Primary Examiner*—Thomas E. Denion

*Assistant Examiner*—Hoang Nguyen

*Attorney, Agent, or Firm*—Sand & Sebolt

[57] ABSTRACT

A hydraulic drive system for actuating a reciprocating member such as a polished rod in a pump jack device, and for acting as a counterbalance and/or for energy conservation. The system has two hydraulic circuits and a prime mover. A first circuit includes a cylinder for driving an output member which may be connected to the polished rod, a first pump of the variable displacement, reversible flow type, together with a pair of fluid lines forming with the cylinder a closed-loop circuit. A controller is programmed to control the setting of the first pump so as to establish the velocity profile of the output member. A second hydraulic circuit is also in the form of a closed-loop containing first and second pumps, at least one of which is of the variable displacement type and is also controlled by the controller. The second and third pumps at least are of the pump/motor types, and the third pump has an input/output shaft connected to a flywheel so that as the third pump is driven as motor, it increases the speed of the flywheel. However, when the second circuit is controlled so that the second pump functions as a motor and the third pump functions as a pump, energy is extracted from the flywheel so that its RPM decreases. The first pump is driven by the prime mover, and the second pump, which can drive the first pump when it is functioning as a motor, may alternatively be driven by the prime mover as well or by both the prime mover and the first pump, if the latter functions as a motor, such as during the down stroke of the polished rod.

24 Claims, 5 Drawing Sheets

HYDRAULIC ACTUATING SYSTEM FOR A FLUID TRANSFER APPARATUS

FIELD OF THE INVENTION

This invention relates to a hydraulic system for use in actuating a stroking apparatus, and more particularly to an actuating system for driving a pump jack in oil fields.

DESCRIPTION OF THE PRIOR ART

In the conventional walking beam type oil lift pump, the drive system of which includes a prime mover having a constant R.P.M. output driving thorough a gear box having a driven output eccentric for oscillating the walking beam, the velocity profile produced at the polished rod is substantially sinusoidal. Because the well characteristics dictate the maximum speed of the rod string at various points along the pumping cycle, adjustment of the prime mover output to accommodate a low maximum speed at one point in the pumping cycle affects speed during the entire cycle. Because of the rigors which the pump jack must endure, and because of the sophistication of adjustment required in attempting to accommodate a particular speed profile customized to a particular well, variable frequency drive mechanisms have not met with success. Acceleration and deceleration results in very high gear load.

In the pumping cycle of the rod string, which is attached to the polished rod, maximum energy input is required during the lifting stroke, and particularly during acceleration thereof after having reached the lower most point of the stroke. In fact, due to the weight of the rod string, a braking force must be applied during the downward stroke of the polished rod, meaning that the energy input to the system normally becomes negative for this part of the pumping cycle, thus making it possible, particularly when light oil is being pumped, to store energy at this time. It is for this reason that in the older conventional pump jack, a counterbalance weight was provided at the end of the walking beam opposite to the connection of the walking beam to the polished rod. Thus, during the downward stroke of the walking beam, the weight on the walking beam is raised to its maximum height so as to store energy which is returned during the up stroke of the rod string and column of oil to assist in its lifting. The velocity of travel of this type of counterweight is also of a sinusoidal profile, and its actual displacement is along an arcuate path of travel. Accordingly, the timing of the return of the energy to the system is, like the velocity profile of the output of the walking beam, fixed.

In the more common type of walking beam pump jack now used, counterbalance weights are mounted on the rotating arms which are driven by the constantly rotating output shafts driven by the gear box output shaft and to which there are connected the drive rods attached to the walking beam. Thus, in this system the counterweights are rotated through a complete cycle and therefore store and retain energy along a very pronounced sinusoidal line. The peak of the return of the energy from the counterweights thus occurs when the rod string has been raised approximately one half of its up stroke, i.e. when the counterweights are at a horizontal position, which is about 90 out of phase with the timing of required maximum input in the raising function. Moreover, as the adjustments of the amount of counterweight required for well conditions is a major and somewhat dangerous task requiring downtime of the pumping process in the weight type counterbalance system, it is not uncommon for conventional pump jacks to be allowed to run with the counterbalance functioning well out of the optimum adjustment which could be obtained with such pump jacks.

The development of hydraulically driven pump jacks, of the type shown in Canadian Patent No. 1,032,064, Minoru Saruwatari, May 30, 1978, entitled "Pump Jack Device", has permitted the customizing of the velocity profile of the polished rod to best suit the well characteristics, and thus result in more efficient and economical pumping of oil, particularly of heavy crude oil. As well, it is feasible to utilize with such a hydraulically driven pump jack a compressed gas counterbalance, which may be mounted immediately on top of the main pump jack cylinder as shown in Canadian Patent No. 1,032,064 or concentrically about the hydraulic cylinder as shown in Canadian Patent Application, Serial No. 615,238, Minoru Saruwatari, filed Sep. 29, 1989, entitled "Fluid Transfer Device" so as to provide a pump jack of less height than that shown in the earlier patent. The compressed gas type counterbalance has significant advantages over the weight type used in the conventional walking beam pump jacks, particularly in the ability to adjust the amount of counterbalance best suited to the well conditions while the pump jack is operating. This is done by varying the gas pressure in the counterbalance system. Such counterbalance systems have experienced some problems, however, with regard to failure of seals, due to the use of high pressures and because of the need to continuously operate the pump jack over long periods of time under severe climatic conditions. Additionally while the amount of energy in total which can in effect be reclaimed from the system, up to a point, can be adjusted, the timing of the reclaiming relative to the downward stroke and upward stroke, is not variable. Thus, the ability to have the most effective use Of the stored energy in the counterbalance system, so as to provide a more constant power input from the prime mover and also to reduce strain on the pump jack, is limited. While using compressed gas provides a better counterbalance system than is possible in the counterbalance type using weights, however, maximum efficiency is still not achievable.

SUMMARY OF THE INVENTION

It is an object of the present invention to provide a hydraulic drive system for a stroking mechanism, such as used in pump jacks, which improves the usefulness of the counterbalance and thus reduces the power required from the prime mover, reduces the stress on the drive system of the pumping components within the well, and permits a pump velocity profile which is well matched to the characteristics of the well.

The drive system of the present invention includes two hydraulic closed-loop circuits. The first circuit consists of a double acting drive cylinder means, a first pump and a pair of fluid lines connecting the cylinder means and the first pump. The cylinder means includes a pair of opposite fluid ports and a stroking output means, and the pump is of the variable displacement, reversible flow type, having a pair of opposite fluid ports and an input shaft. The fluid lines connect the ports of the cylinder means and of the pump so as to form a first closed-loop hydraulic circuit. The second closed-loop hydraulic circuit includes second and third pumps, each having an input/output shaft, a pair of opposite fluid ports, and a second pair of fluid lines connecting the ports of the second and third pumps to form the second hydraulic closed-loop circuit. The second and third pumps can function as a pump/motor means and at least one of them is of the variable displacement type. The system also includes a prime mover having an output shaft means drivingly connected with the input shaft of the first pump in the first hydraulic circuit and the input/output shaft of the second pump in the second hydraulic circuit. A flywheel is drivingly connected with the input/output shaft of the third pump for receiving rotating drive therefrom and for transmitting drive power thereto. The system further includes a control means for establishing the setting of said first pump to establish the quantity and direction of flow of fluid in the first closed-loop circuit and to thereby determine the direction and velocity of travel of the output means of the cylinder means, and for setting the displacement within either the second or third pumps to thereby establish the function of the second pump as a motor or a pump.

Accordingly, the system of the present invention utilizes the first closed-loop circuit to control the velocity profile of the polished rod of the pump jack, which may be connected directly to the output means of the drive cylinder means. While energy may be directed from the prime mover, or even recaptured from the first circuit during the downward travel of the polished rod, as will be described in more detail below, and utilized to increase the RPM of the flywheel. The energy thus stored due to the increased velocity of the flywheel, is then available to be returned to the fluid in the first closed-loop circuit through the second closed-loop circuit by utilizing the second pump as a motor for driving the first pump during upward travel of the polished rod.

BRIEF DESCRIPTION OF THE DRAWINGS

Embodiments of the present invention are illustrated as examples in the accompanying drawings, wherein.

DESCRIPTION OF THE PREFERRED EMBODIMENTS

Figure 1:
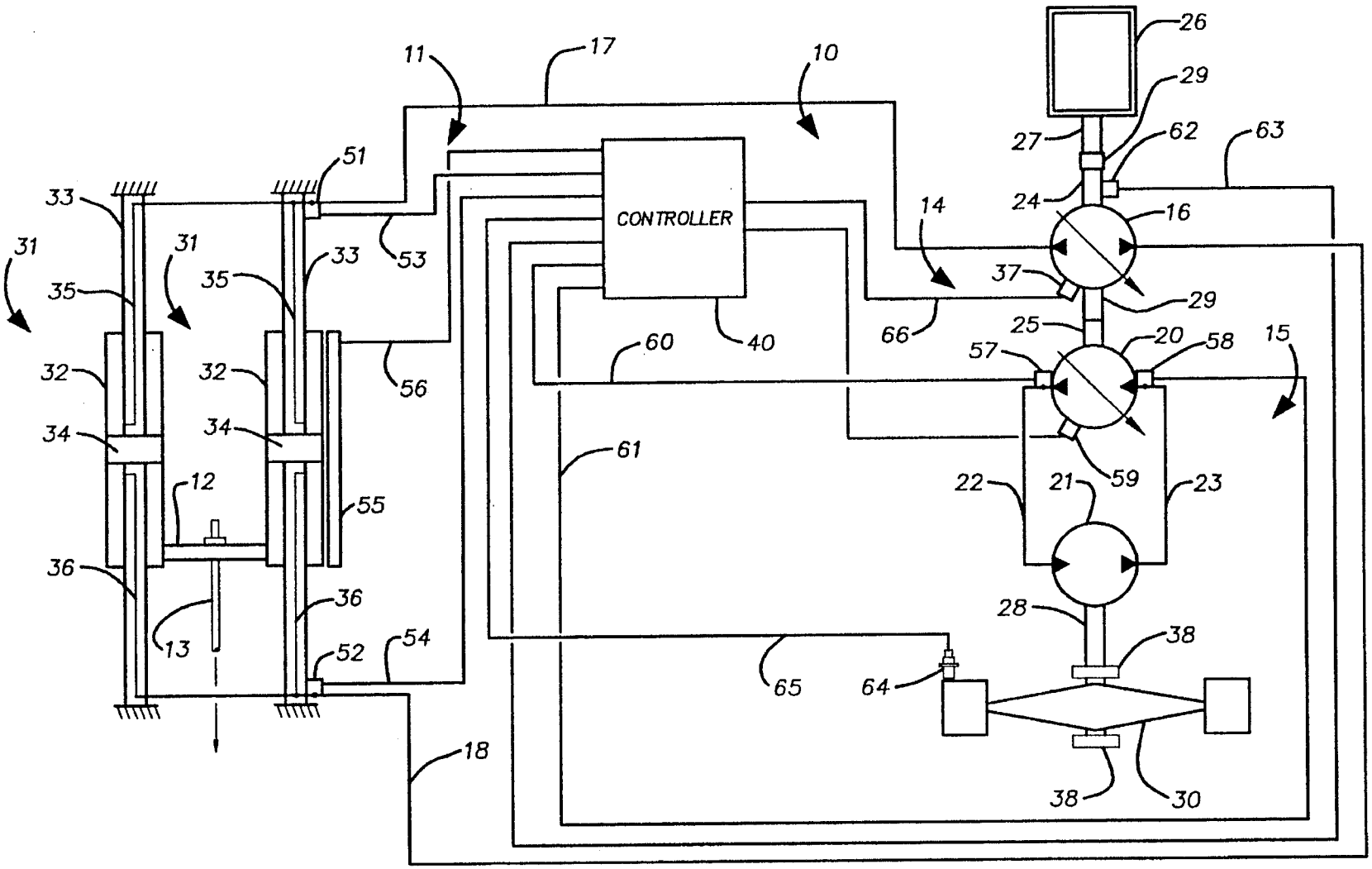
FIG. 1 is an electrical/hydraulic schematic of one embodiment of the drive system of the present invention.

As shown in FIG. 1, the reference number 10 denotes the drive system of the present invention which includes an equal displacement cylinder means 11 having an output means 12 for attachment to a polished rod 13 of an oil well (not shown). The system 10 includes two principal hydraulic circuits 14 and 15. The first hydraulic circuit 14 includes a pump 16 and a pair of hydraulic lines 17 and 18 connected between the pump 16 and the cylinder means 11 to form a closed-loop hydraulic circuit. The second hydraulic circuit 15 includes pumps 20 and 21 connected by a pair of hydraulic lines 22 and 23 to form a second closed-loop hydraulic circuit. Pump 16 has an input shaft 24, and pump 20 has an input/output shaft 25. A prime mover 26, which may be in the form of an electric motor or an internal combustion engine, has an output shaft 27. A drive connecting means 29 connects the output shaft 27 of the prime mover 26 in a manner for driving the input shaft 24 of pump 16 in the first circuit and the input/output shaft 25 of the pump 20 in the second hydraulic circuit. The drive connecting means 29 may also serve to connect the input/output shaft 25 of pump 20 in a manner to permit transfer of driving power from pump 20, which is a pump/motor means, to the input shaft of the pump 16. The pump 21 is also of a pump/motor type and has an input/output shaft 28. A flywheel 30 is connected with the input/output shaft 28 for receiving rotating drive therefrom or for transmitting driving power to the pump 21. The flywheel 20 is shown as being fixed to a shaft which is connected directly to the input/output shaft 28 and mounted in bearings 38,38.

In the embodiment of the hydraulic displacement cylinder means 11 shown in FIG. 1, it is in the form of a pair of parallel hydraulic cylinder means 31,31 of the through rod type and wherein the cylinders 32,32 reciprocate. Through piston rods 33,33 are fixed or supported at opposite ends and are thus stationary, as are the pistons 34,34 which are affixed to the rods 33,33. The cylinders 32,32 are mounted for reciprocation in unison and are connected by the output means 12 which is in the form of a crossbar. One hydraulic line 17, which is in communication with one port of the pump 16, is connected by way of internal passages 35,35, which extend through the piston rods 33,33 to ports which are internal of the cylinders 32,32 above the pistons 34,34. The other hydraulic line 18 is in communication with the inside of the cylinders 32,32 below the pistons 34,34 via passages 36,36 in the piston rods 33,33. It can be seen, therefore, that as the pump 16, which is of a variable displacement, reversible flow type, is set on one side of dead center to supply pressurized fluid to the upper side of pistons 34,34, through line 17 and passages 35,35, while fluid is allowed to return to pump 16 through passages 36,36 and line 18, the cylinders 32,32 are forced upwardly, thus imparting a lift stroke to the polished rod 13 and the rod string attached thereto. Alternatively, when line 18 is supplied with pressurized fluid while fluid is permitted to return to pump 16 via line 17 from above the pistons 34,34, the cylinders are moved to a lowered position.

It is of course possible to utilize a pair of through piston rod type pistons, wherein the cylinders are stationary and the piston rods reciprocate, as will be described in more detail below in relation to FIG. 4. Alternatively, a single cylinder can be used which may be mounted directly above the well head with the piston rod is aligned with and connected directly to the polished rod. The reason a through piston rod type cylinder, or a pair of such cylinders mounted in parallel, is used is that in a closed-loop circuit, the same amount of fluid must enter the cylinder at one end as is simultaneously evacuated from the opposite end to accomplish the up and down strokes. Alternative arrangements are possible, such as the use of as pair of like single piston rod cylinders, wherein one hydraulic line is in communication with both the inner end of a first cylinder and the outer end of a second cylinder, while the second of the pair of hydraulic lines is connected to the outer end of the first cylinder and the inner end of the second cylinder. With such an arrangement one cylinder expands when the second contracts, but the cylinders may be mounted in such a manner to rock a beam which is connected to the polished rod. There are other equivalent hydraulic mechanisms which would be obvious to one skilled in the art, including a rotating hydraulic motor in the closed-loop circuit in place of the illustrated through piston rod cylinders, and wherein the rotating output of the motor is translated into a reciprocating motion for stroking the polished rod.

Figure 4:
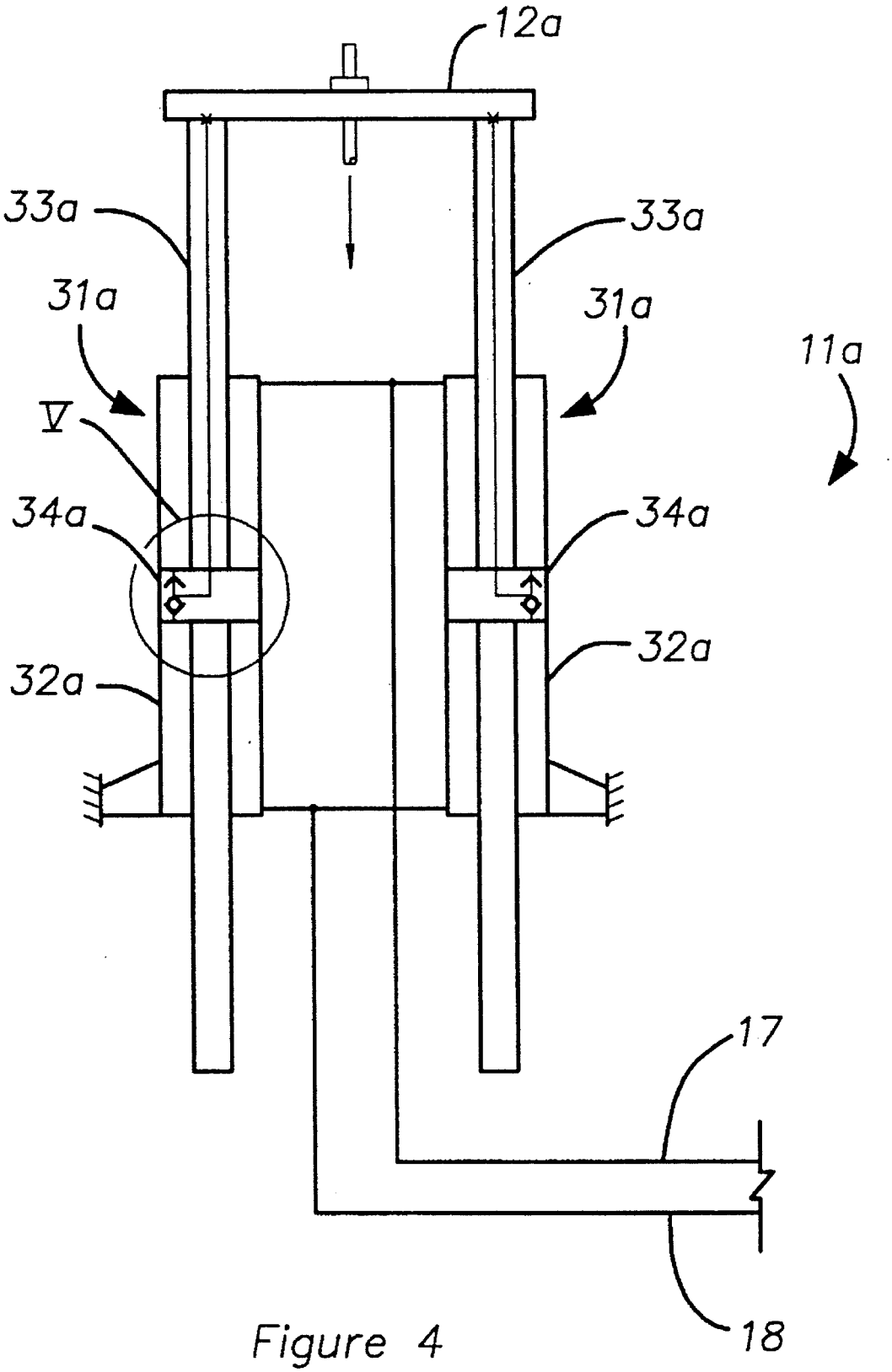
FIG. 4 is a view of an alternative form of the equal displacement cylinder means of the present invention.
Figure 5:
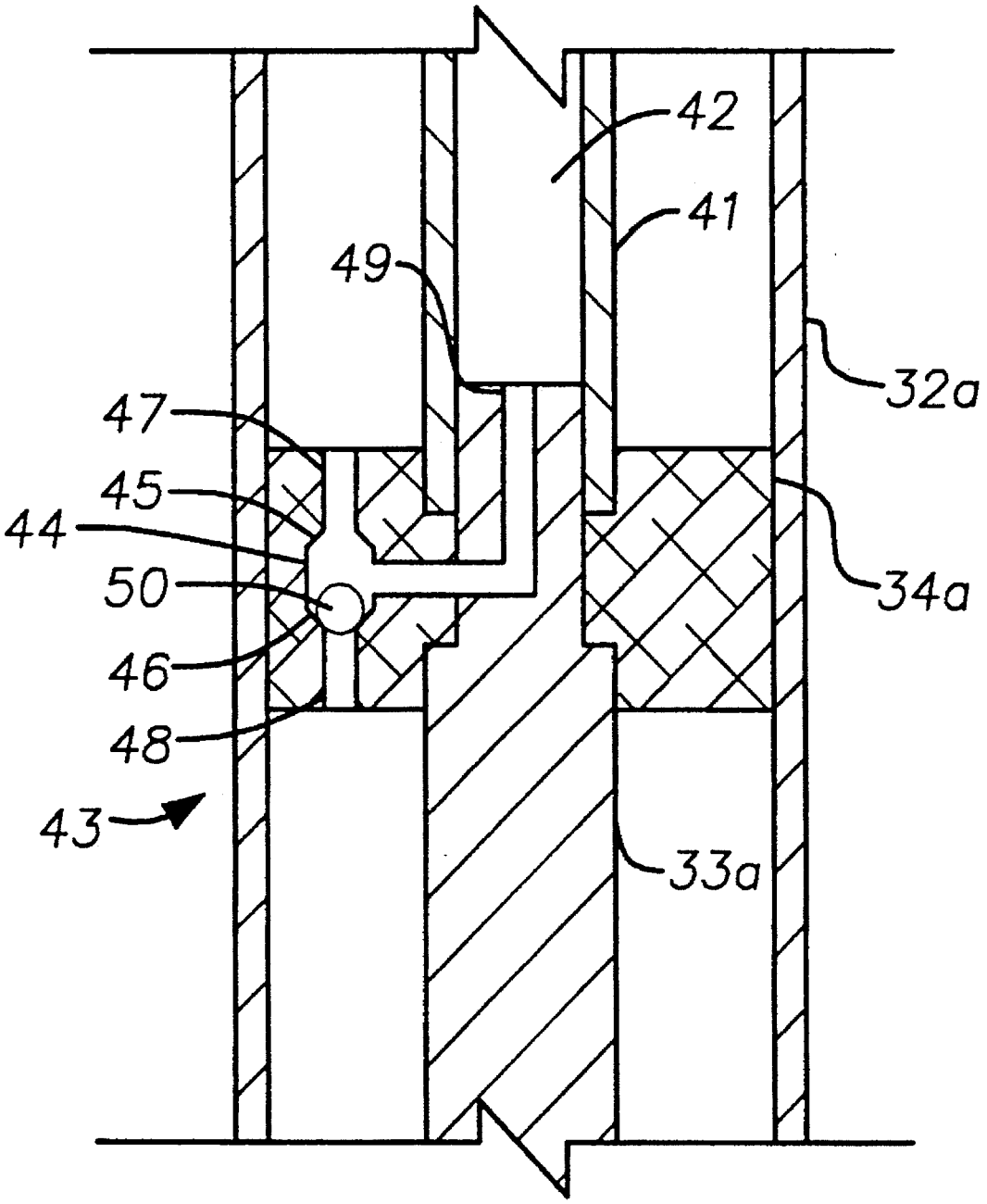
FIG. 5 is an enlarged vertical cross-section of the piston and cylinder with the circle V of FIG. 4.

Referring now to FIGS. 4 and 5, hydraulic lines 17 and 18 are connected in a hydraulic circuit such as that shown in FIG. 1, but the equal displacement cylinder means 11*a*, include a pair of parallel hydraulic means 31*a*, 31*a* wherein hydraulic cylinders 32*a*,32*a* are fixed instead of the piston rods of the earlier embodiment. Through piston rods 33*a*, 33*a*, to which are affixed piston 34*a*, 34*a*, within the cylinders 32*a*,32*a*, extend through upper and lower ends of the cylinder 32*a*, 32*a*. Hydraulic line 17, which is connected to one port of the pump 16 is connected to ports communicating with the interior of the upper end of both cylinders 32*a*,32*a*. Hydraulic line 18, which is in communication with the opposite port of pump 16 is connected to ports communicating with the interior of both cylinders 32*a*,32*a*, at the bottom end of the cylinders. An output means in the form of a crossbar 12*a* is connected to both of the piston rods 33*a*, 33*a*, at the upper ends thereof, and the polished rod, or a rod which is connected to the polished rod of the well, is connected to the crossbar 12*a* so that as the piston rods are forced up, the polished rod is pulled up, and as the piston rods 33*a*, 33*a* are caused to descend, the polished rod also moves downwardly thereby causing the up and down strokes of the rod string.

In the embodiment shown in FIGS. 4 and 5, the portion of each through piston rod 33*a*, which projects through the top of the cylinder 33*a*, is under heavy compression during the upward stroke, particularly after the turn around at the bottom of the downward stroke of the rod string, and in fact, in most well situations, the upper portion of the through piston rod remains under considerable compression during the down stroke of the polished rod. The structure illustrated in the enlargement section view of FIG. 5 allows for the use of a smaller piston rod, which is thus lighter and less expensive, while providing for higher power output, for a cylinder of a given diameter. While the outer diameter of the lower portion of the piston rod 33*a*, which extends through the bottom of the cylinder 32*a*, is the same as the upper portion of the piston rod which extends up through the top of the cylinder 32*a*, the upper portion, unlike the lower portion, is not a solid rod but is in the form of a tubular member or hollow rod 41. The hollow rod 41 remains full of fluid 42 at all times, but this fluid is exposed to the pressure of the fluid in the end of the cylinder which is being subjected to the higher pressure at any instant. The existence of the high fluid pressure in the interior of the upper portion of the piston rod in effect applies a tension force to this portion of the rod to at least partially negate the high compression force on the rod and thereby resist buckling of the upper portion of the piston rod.

The fluid 42 within the hollow rod is automatically subjected to the pressure on either side of the piston 34*a*, whichever pressure is higher, by way of the action of a shuttle valve 43. A shuttle valve chamber 44 is connected by a passage 49 to the interior of the hollow rod 41, and the shuttle valve chamber 44 has opposite ports 45,46 connected by passages 47 and 48 in the piston 34*a* to the fluid above and below the piston, respectively. Accordingly, when the line 17 is receiving pressurized fluid from pump 16, and line 18 is exhausting fluid from below the piston 34*a*, a shuttle member 50 is forced against port 46 to close passage 48. The shuttle valve chamber 44 and fluid 42, via passage 49, is thus exposed to the high fluid pressure above the piston through passage 47. Alternatively, when line 18 is exposed to high pressure fluid and line 17 is permitting the exhaust of the fluid above the piston 34*a*, the shuttle member 50 is caused to reverse its position so as to allow the higher pressure below the piston 34*a* to be exposed to the fluid 42 within the hollow rod 41.

As indicated above the pump 16 is a variable displacement, reversible flow pump, preferably of the swashplate type, wherein the swashplate position is controlled by a control unit indicated at 37. The pump further includes in combination with the control unit an auxiliary pump (not shown) which draws fluid from a systems reservoir (not shown) for make-up and control actuation. The control unit receives an Electronic Displacement Control signal (EDC) from a main controller 40 so as to position the swashplate and thereby control the pump displacement and thus the quantity of flow through one port to hydraulic line 17 while the same quantity of flow enters an opposite port connected to hydraulic line 18. Control of the quantity of flow in the opposite direction in the closed-loop circuit 14 during the opposite stroke of the polished rod is achieved as the swashplate is moved across dead-centre and thereafter set at various positions of displacement on the opposite side. As will be described in more detail below, it is proposed that in most installations, pump 16 will also be called upon to act as a pump/motor unit so as to be able to utilize the circulation of pressurized fluid in the closed-loop circuit 14 to drive its shaft 24 whereby the shaft functions as an output shaft, and thus termed herein as an input/output shaft.

Pump 20 of the second closed-loop circuit 15 is also shown as a variable displacement pump which may be of the swashplate type. While this pump need not be of the reversible type, because the fluid in closed-loop circuit 15 always circulates in the same direction, it is necessary that it be a variable pump and be capable of acting as a pump or alternatively as a motor driven by the fluid circulation, i.e. pump 20 must function as a pump/motor. This pump's displacement setting is also controlled by a control unit denoted 59, which receives a separate Electronic Displacement Control signal (EDC) from the main controller 40 so as to position the swashplate of pump 20 and thereby control the quantity of flow of fluid therethrough. Pump 20, like pump 16, contains within its control unit an auxiliary pump system for make-up and control actuation. Pump 20 performs as a pump when it is transferring energy into the closed-loop circuit 15 and thus to the pump 21, or as a motor when it is transferring energy out of closed-circuit 15 to the input shaft of pump 16. In either mode the circulation of the fluid in the circuit is in the same direction, i.e. counterclockwise.

Shown in the embodiment as viewed in FIG. 1, pump 21 is required to function as a motor when the fluid pressure in hydraulic line 22 is above that in hydraulic line 23, and as a pump when the relative pressures are reversed; thus this pump can be termed a pump/motor as well.

When pump 21 functions as a motor driven by the circulated fluid being pumped by pump/motor 20, the input/output shaft 28 functions as an output shaft to in effect store energy in the flywheel 30 by increasing its speed (RPM). When the pump/motor 21 functions as a pump, its input/output shaft functions as an input shaft, returning energy from the flywheel to drive the pump 21. The pumping of fluid into line 23 from line 22 increases the pressure in line 23 and thus, the return of the energy into the pressurized fluid from the flywheel decreases the flywheel speed. Accordingly, in the embodiment shown, pump/motor 21 need not be either of a reversible flow or of a variable displacement type, and thus it does not include a control unit from receiving signals from main control 40 as in the cases of pumps 16 and 20.

It should be apparent in view of the description of the function of the overall closed-loop circuit 15 that the same results could be obtained by switching the positions of pumps 20 and 21, i.e. by using a variable displacement pump with means for control from main control 40 to transfer energy to or extract energy from the flywheel. It is then possible to use a pump/motor unit which is not of a variable displacement type for automatically transferring energy to the circuit or transferring energy to pump 16, depending on the relative fluid pressures in lines 22 and 23 as established by the controlled pump/motor connected to the flywheel.

Figure 2:
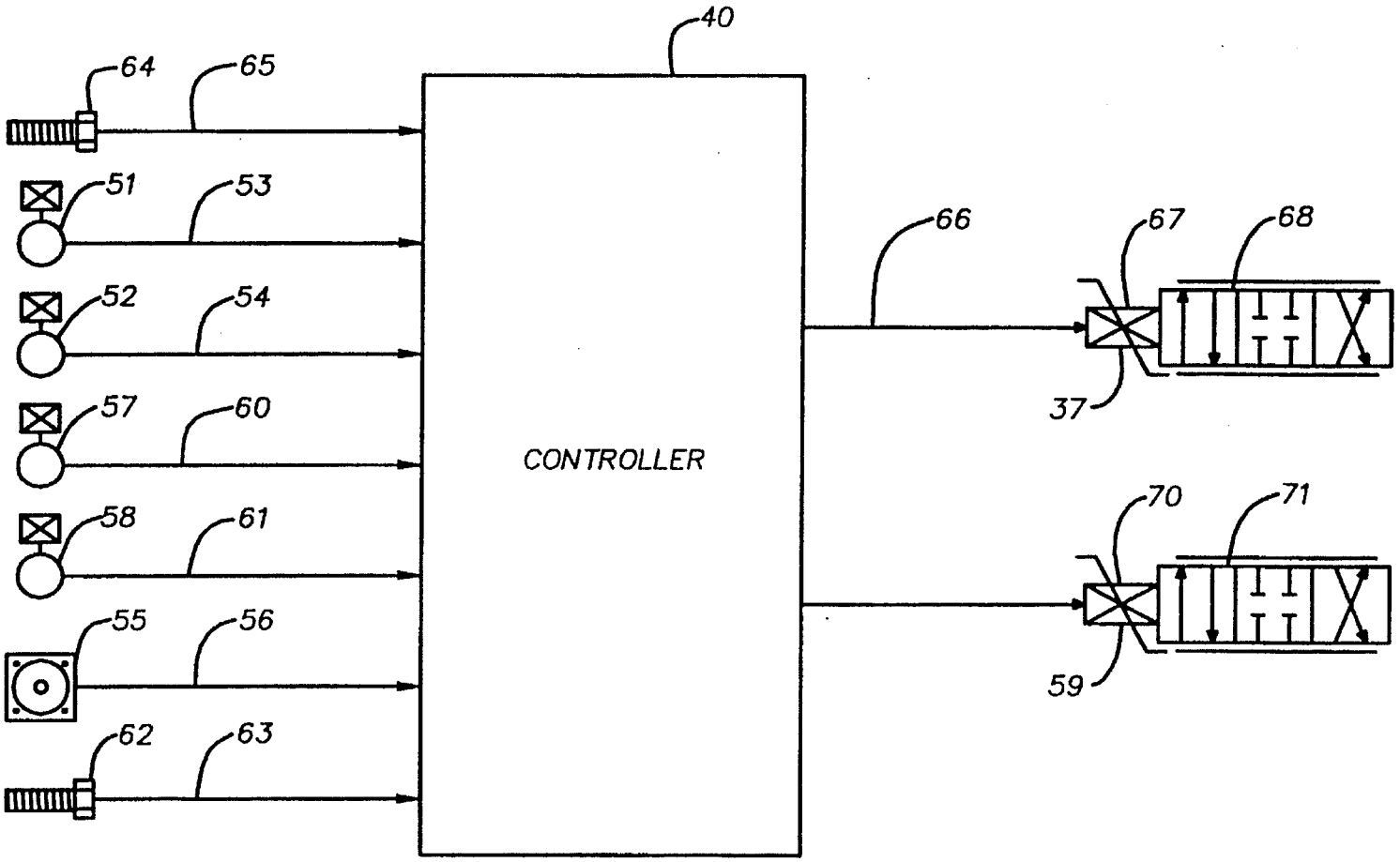
FIG. 2 is a schematic showing only the control means isolating the control sensors, main controller and control valves of the embodiment of FIG. 1.

The system shown in FIGS. 1 and 2 includes in its control means a number of sensors for informing the main controller of parameters existing in the system. The parameters are used by the main controller 40 in conjunction with programmed information so the controller is capable of providing the EDC signals which in turn establish the instantaneous settings of the displacements in pumps 16 and 20. The main controller 40, which may be in the form of a personal computer with input/output (I/O) boards added to the expansion bus, is capable of monitoring various parameters of the system to thereby control the velocity profile of the polished rod which is its prime function. It further controls the input of energy to and output of energy from the counterbalance system which is in the form of the closed-loop hydraulic circuit 15 and the flywheel 30 driven thereby.

There are depicted at 51 and 52 separate sensors for providing signals via electrical lines 53, and 54, respectively to inform the controller 40 of the hydraulic pressure in the hydraulic lines 17 and 18, respectively, and thus the fluid pressures above and below the piston 34,34 in the cylinders 32,32. These sensor may be mounted on the pump 16 and plumbed into the opposite inlet/outlet ports thereof. These pressures, provide information allowing the determination of a number of values, including the lifting force in the cylinders 32,32 and thus the polished rod load. The signals provided by the sensors 51,52 to the controller may be in the form of an analog voltage or current. Also the pressures may be measured with the use of a single sensor plumbed into a shuttle valve connected across the lines 17 and 18.

A position encoder or sensor 55 is provided for measuring the position of the cylinders 33,33 and supplying a signal via line 55 to the controller 40, so as to give information representative of the instantaneous position of the polished rod in its pumping cycle. This stroke encoder or sensor 55 may be of a type to produce a signal consisting of a minimum of three separate signals, i.e. 3 digital channels. Two of such signals will generate a quadrature output signal. By counting the number of pulses generated, distance moved can be determined. By measuring frequency of pulses, velocity can be determined and by determining the phase between the two signals, direction of motion can be found. Also, one or more signals are required to indicate an index or reference position as the quadrature output signals are not an absolute indication of position. As operation of the system is initiated, the polished rod position is not known by the controller 40, and adjustment must be made to establish a fixed reference position by way of information provided from the sensor 55.

Pressure sensors 57 and 58 are provided in closed-loop circuit 15, which may be plumbed into the opposite inlet and outlet ports of the pump 20. Lines 60 and 61 connect the sensors to the main controller so that signals produced by the sensors are indicative of the pressures in hydraulic lines 22 and 23 and are continuously supplied to the main controller for use in determining, among other things, the EDC output of the controller for setting the displacement of pump 20, and thus the energy input into closed-loop circuit 15 or the energy transferred therefrom. The signals provided from the sensors 57 and 58 may be in the form of an analog voltage or current. Again, as an alternative to the use of the two sensors 57 and 58, it is possible to use a single sensor in combination with a shuttle valve to obtain separate pressure readings from hydraulic lines 22 and 23.

It is further preferable to utilize a speed sensor 62 for providing a signal which is indicative of the speed (RPM) of the output shaft 27 of the prime mover 26. The sensor 62 may be of the gear tooth type, and the signal provided thereby is fed to the main control via line 63. Similarly, a speed sensor 64 is used to supply a signal indicative of the flywheel speed (RPM), the signal being transmitted to the main controller 40 via line 65. The RPM signals from sensors 62 and 64 may be in the form of digital signals.

On installation of the pump jack system 10 on a particular oil well, initial testing is conducted to establish an optimum velocity profile for the rod string to achieve most efficient pumping from the oil well. Various factors come into play. To efficiently extract oil from a well, it is important to complete each overall pumping cycle as quickly as possible so as to achieve the maximum number of pumping cycles per unit of time. The amount of time for one complete cycle is shown at "a" in FIG. 3. Shown at "b" and "c" are the periods of time during which the polished rod is travelling upwardly and travelling downwardly, respectively There may be dwell times "d" and "e", between the end of the downward stroke and the start of the upward stroke and between the end of the upward stroke and the start of the downward stroke, respectively. A factor affecting the dwell time, for example, relates to the viscosity of the oil being pumped, as the efficiency is decreased when the stroke commences before the full quantity of oil has passed into the downhole pump. The length of the travel times "b" and "c" depend, of course, on the rate of acceleration and deceleration which can be used, those being shown as "f" and "g" for the lift stroke and "h" and "i", respectively, for the down stroke. The length of the travel time also depends on the maximum velocities which can be used, as the higher the velocities, the shorter the duration over time periods "j" and "k". The velocities may remain substantially constant over these periods where "j" represents the maximum and constant velocity used during the lift stroke and "i" represents the maximum and constant velocity used over the down stroke. What represents acceptable acceleration values and maximum velocity values is governed, of course, as to what stress can be caused in the equipment, including the rod string, to avoid costly maintenance. These values also depend on the maximum power input available from the prime mover 26.

Figure 3:
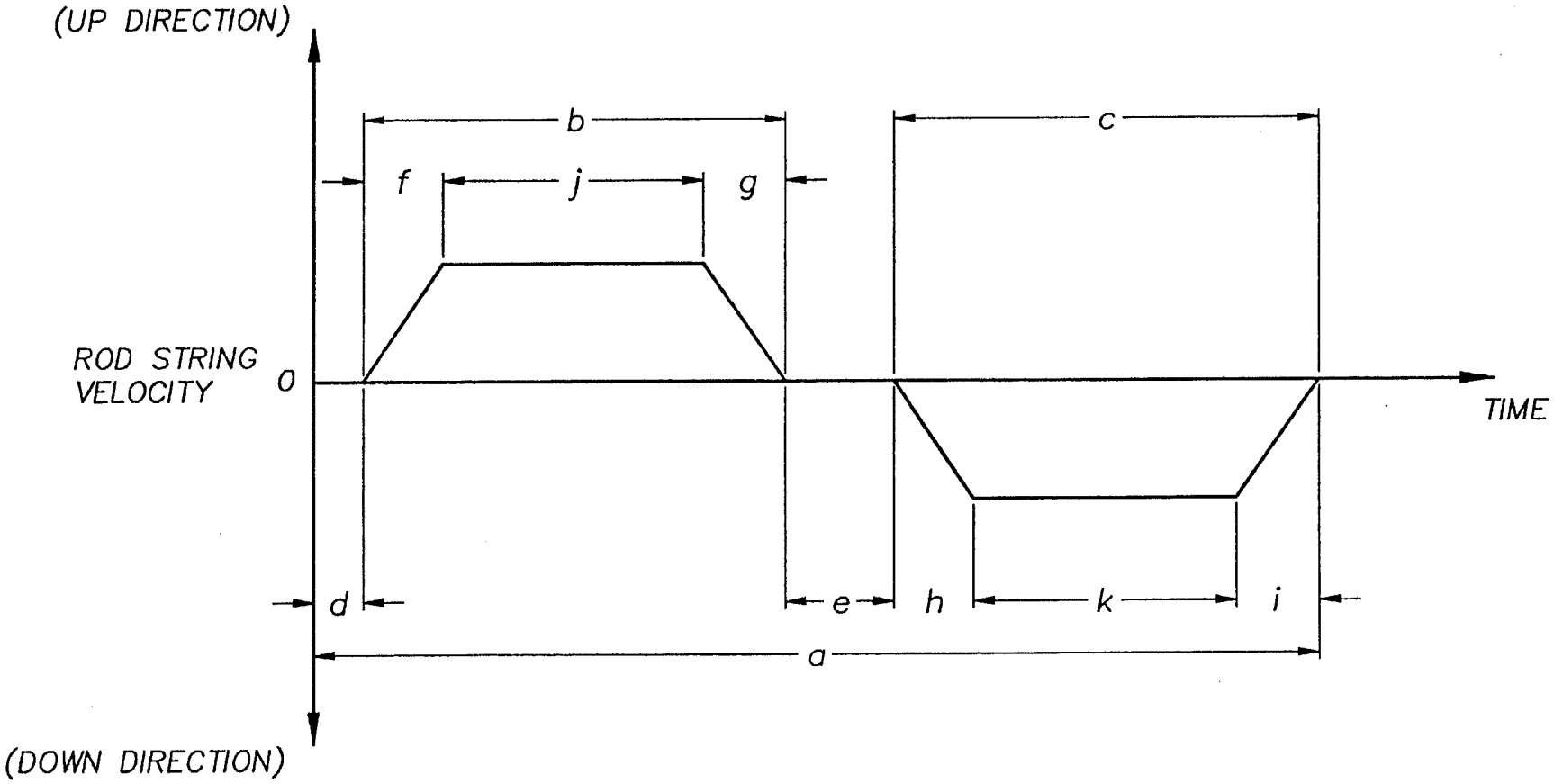
FIG. 3 shows a simplified graph of a velocity profile of the rod string, i.e. rod string velocity v. time.

In the diagram of FIG. 3, the constant velocity during the period "k", which occurs during the downstroke of the polished rod, is shown as being equal to that which occurs, except in the opposite direction, during the lift stroke at "j". Such a situation may not be possible in all wells, since in heavier crude oils, the descent of the rod string, which cannot be forced, may occur at a rate which is below that at which the lift stroke occurs. Moreover, due to the stretch of the rod string which is significant in a long rod string, the movement of the downhole end of the rod string does not coincide, time wise, with that of the polished rod. While it may be possible to take some advantage of the rod stretch to achieve certain pumping characteristics, it does affect the optimum velocity profile selected for the polished rod, and as the rod stretch does represent a storage of energy, it also has an affect on requirements of the counterbalance system with respect to the time and amounts of the energy input and output of the system. In any event, as indicated above, the maximum velocities will be established which allow the pump jack to operate at the maximum velocities without exceeding the system's limits. The rod string minimum and maximum loads, as well as the upper power limit of the prime mover, can be programmed into the main controller. If at any time in the total stroke cycle these limits are exceeded, the main controller can react by reducing the velocity of the rod string.

Considering first, a situation where exceptionally heavy crude oil is not being pumped so that the oil viscosity is such that under free fall the rod string would significantly exceed the velocity indicated for the duration "k" of FIG. 3, it is obvious that the counterbalance system can function to receive energy from the pump jack for storage in the rotating flywheel. First, however, one might consider the pumping cycle as experienced by the polished rod, the velocity of which has been programmed to follow the line as shown in FIG. 3, starting at the dwell "d" immediately preceding the acceleration for the lift stroke. At this point, the flywheel will be rotating at a high speed for reasons which will become apparent below, and its RPM will be known by the main controller 40 by way of sensor 64. Also the output shaft 27 of the prime mover 26 will be rotating, and the rotation of this shaft may be substantially constant at all times, particularly if the prime mover is an electric motor. In any event, the main controller 40 will also be aware of the RPM of shaft 27 by way of sensor 62.

The drive connection means 29 may be a gearbox driven by output shaft 27 and having a pair of output shafts connected directly to the shafts 24 and 25 of pumps 16 and 20, respectively, instead of being connected only to input shaft 24 of pump 16 as shown in FIG. 1. Such a gearbox may be designed so that it has two output shafts which rotate at the same speed, but in any event the input shafts of each of pumps 16 and 20 will be rotated at a speed which directly relates to the known speed of output shaft 27 of the prime mover 26. As the drawings indicate, however, there are in fact commercially available variable displacement pumps of the type required in such an installation for connecting together in a twinned fashion so that the shafts are attached for rotation together. Thus, as shown, only one pump such as pump 16 would be drivingly connected to the output shaft 27 or to an intermediate gearbox 29 driven by the prime mover 26.

In the illustrated embodiment, the prime mover 26 will have a known optimum maximum power output which will be programmed into the main controller, and because of the presence of the counterbalance system represented by the second hydraulic circuit 15, this maximum power output may be significantly less than that required to accelerate the polished rod and to drive it at the maximum velocity as indicated for the durations "f" and "j", during the lift stroke. The main controller 40 will be programmed, nevertheless, to provide at this point an EDC signal, via line 66, to the control unit 37 of pump 16, to increase the displacement of the pump in a direction to cause pressurized flow into line 17 and to draw fluid from line 18. As illustrated in FIG. 2, the electrical current signal sent to control unit 37 energizes a variable solenoid 67 which actuates a proportional valve 68. The solenoid and proportional valve are part of the control unit 37 and as the valve 68 is shifted, a flow of fluid is effected to shift the position of the swashplate of pump 16. Thus, a known change in the electrical current which forms the EDC signal is translated into a predetermined amount of shifting of the swashplate, which in turn varies the pump displacement to cause the instantaneous quantity of flow into line 17 from line 18 to bring about the upward displacement of cylinders 32,32 causing the rate of acceleration of the polished rod as indicated for the duration "f". When the velocity shown at the level indicated during period "j" is reached, the swashplate position of pump 16 is maintained by the EDC signal to pump control unit 37 to provide the optimum, substantially constant velocity until the upper end of the stroke is approached. The EDC signal via line 66 from the main controller 40 then provides for a shift of the swashplate in the pump 16 to decelerate the polished rod to a stop. After the dwell time "e", the swashplate of pump 16 is passed over centre to commence the flow from line 17 to line 18 at a rate to achieve acceleration of the polished rod for the duration "h". Having reached the maximum velocity as represented by the flat line of the duration "k", the flow is maintained at a rate to maintain that velocity, followed by a shift of the swashplate back towards the neutral position for deceleration as the polished rod reaches the bottom of the stroke. As the swashplate reaches its dead-centre position, this completes the full cycle of the polished rod, and subsequently the upward stroke is commenced as previously described.

The instantaneous load being applied to raise the polished rod 13 by the upward movement of cylinders 32,32 is known because of the information of pressure above and below the piston of both cylinders as sensed by sensors 51 and 52, respectively. The controller 40 is also aware of the upward velocity because of the information provided by the sensor 55, as described above. The amount of power input to the pump jack at any instant via pump 16 is thus calculable from the velocity and pressure readings. As well, the value of the EDC to the controller 37 is a direct indication of the swashplate setting and thus the displacement of the pump. The quantity of flow in the circuit 14 is directly related to the displacement and pump RPM, and together with the pressure readings of lines 17 and 18 provide a source of information to the main controller 40. The controller is programmed to maintain information of previous pumping cycles and can thereby verify the correctness of the EDC output, for example, and make on tile run adjustments if necessary. Also, as previously indicated, if external conditions change, such as the requirement of a greater load to achieve the previously set maximum upward velocity of the polished rod, the velocity may be reduced, for example, or a system shut down is indicated if the change is severe.

It is desirable for equipment longevity and low operating costs to operate the prime mover 26 at a relatively constant power output. The main controller 40 can be programmed to achieve this by controlling energy flow via pump 20 into the second hydraulic circuit, including the flywheel 30, and the flow of energy therefrom at specific required times. Describing the energy requirements for a relatively simple pumping cycle, where the crude oil is relatively light, and settings are not made to take into account rod string stretch, the amount of power required at the beginning of the upward stroke, as discussed above, increases very rapidly for acceleration. The power input to the first hydraulic circuit 14 then remains substantially constant, but relatively high during the time period "j", and falls off quickly during deceleration at the end of the upward stroke. As described, the main controller 40 is supplied with information continuously, which allows it to maintain the desired velocity profile for the polished rod and to simultaneously calculate from this information and that which has been programmed into the main controller, exactly what energy is required in total at any instant. The controller is thus able to determine what power need be added to that being supplied by the prime mover 26 so that the prime mover 26 preferably does not have to significantly vary its output. Thus, the controller 40 provides an EDC output signal to the control unit 59 of pump 20 which has a variable solenoid 70 and a proportional valve 71 which functions in substantially the same manner as the corresponding components of control unit 37. The swashplate of the pump 20 need not be of the type to pass over centre as the direction of flow in the second hydraulic unit 15 is always in the same direction. The magnitude of the signal, however, controls the position of the swashplate to vary the displacement of the pump 20, and thus the quantity of flow in the single direction.

Because the energy input to the pump jack to commence raising the polished rod is high, the EDC signal provided from the main controller 40 to the control unit 59 of the pump 20 causes a shifting of the swashplate of this pump so as to vary the pump's displacement to a degree that the fluid pressure in line 23 is higher than that in line 22. To this point pump 21 had been driven by the fluid circulating in circuit 15, for increasing the rotational speed of the flywheel 30, i.e. it performs the function of a motor. Pump 21 now commences to function as a pump, and thus, as the flywheel 30 drives pump 21, energy is extracted from the flywheel to pressurize the fluid delivered to line 23, which energy is extracted from the fluid as it drives pump 20 as a motor. The output power derived from this energy drives shaft 25 which adds to the input of prime mover 26 for meeting the energy input required by pump 16. The pump 16, in turn, meets its committment, as set by the setting of this pump by the main controller 40, via the EDC signal delivered to the control unit 37 of pump 16. This EDC signal is determined, as explained above, to establish the desired velocity profile of the polished rod. The EDC signal provided by the main controller 40 to the control unit 59 of pump 20 is determined by the main controller to set the swashplate of pump 20, now functioning as a motor, to extract from the momentum of the flywheel 30, energy through the pumping of pressurized fluid to line 23, sufficient to ensure that the load placed on the primer mover 26, during the duration "f" and then "j", and possibly part of the duration "g" does not exceed the designated maximum load of the prime mover 26. Depending on the requirements of the input to the pump jack, and the amount of energy which can be collected during the remainder of the pump cycle, as will be described in more detail below, the amount of energy extracted from the counterbalance system during the upstroke of the polished rod, may in fact, allow the prime mover 26 to operate at a constant power output. This output may be at a load considerably below that of its allowable maximum.

In the type of installation being described, once the polished rod commences its downstroke, the force caused by the weight of the string rod will in effect be braked by the fluid in the cylinders 32,32 above the pistons 34,34, resulting in the pressure in line 17 being above that in line 18. The downward acceleration of the polished rod for duration "h" the constant downward velocity of the polished rod for the period "k", and then the deceleration for the duration "i" are all again controlled by the setting of the swashplate of the pump 16 by the EDC signal received from the controller. During these durations the swashplate setting is on the opposite side of dead centre than during the upward stroke, and the pump 16 is being driven, so as to be functioning as a motor. Due to the interconnection of the shaft 24 and 25 of the pumps 16 and 20, the output power derived from the pump 16 controlling the flow of the high pressure fluid from line 17 to the lower pressure line 18, is transferred to pump 20. The EDC signal received from the main controller 40 by the control unit 59 establishes a setting for pump 20 so that the pump establishes a higher pressure in line 22 than in 23, i.e., it again acts as a pump instead of a motor. This causes pump 21 to function as a motor in that it receives fluid at a higher pressure than what is delivered to line 23. Acting as a motor, it commences to again increase the speed of the flywheel, which had been slowed during the upstroke of the polished rod. Moreover, as an energy input is not required by pump 16 from the prime mover, the setting of the displacement of the pump 16 is such to provide an output speed of its shaft 24 in relation to the output speed of the shaft 27 of the prime mover, that the output power of the prime mover 26 is also transferred to the shaft 25, which at this time is acting as an input shaft of the pump 20. By properly balancing the amount of energy stored in the flywheel 30 and the desired output of the prime mover 26 with the total energy required during the upstroke of the polished rod, the output power of the prime mover required during the upstroke can be substantially equalled to that needed to be added to the counterbalance system during the downstroke.

If an installation involving the pumping of exceptionally heavy crude oil is now compared with the above, it is possible that because of the slowness of the rod string returning from its raised position, very little braking is required by the resistance provided by the pump 16 functioning as a motor for at least some of the total duration of "h"+"k"+"i". This would mean, of course, that little or no energy is returned from the first circuit 14 to what has been referred to as the counterbalance circuit 15 during the downstroke of the polished rod. Nevertheless, the second circuit 15 is still capable of performing the important function of storing energy provided by the prime mover 26 during the downstroke. As the second circuit is then functioning more as an energy conservation circuit, its function is less as a counterbalance system as such. The usefulness of the system used in this manner is nevertheless clear in that the energy used during the upward stroke is derived from both the prime mover and the second circuit 15, again allowing the energy input from the prime mover 26 to remain substantially constant and at a level considerably below the maximum energy level required during the upstroke.

It is apparent, however, the lower the viscosity of the crude being pumped, the more energy utilized in raising the rod string can be retrieved by the first circuit and returned to the counterbalance circuit. The counterbalance or second hydraulic circuit may be simultaneously storing energy from the prime mover 26 which is not required in the first circuit during the downstroke. As the viscosity of the crude in a well becomes higher, the second circuit may derive less energy being retrieved from the downstroke in the pump jack, but nevertheless it is fully capable of storing energy to allow the use of a smaller prime mover and avoid higher peak inputs.

In the disclosed embodiment, the main controller 40, in combination with the first hydraulic circuit 14, is capable of providing a customized velocity profile for the polished rod and also a return of energy retrieved from the downstroke of the rod string to the second circuit. The main controller 40, in combination with the second circuit, is capable of storing energy retrieved by the first circuit and/or directly from the prime mover whenever such energy is available, and then returning it to the first circuit at whatever time it is most efficient to do so.

While an embodiment of the invention has been described above as an example of the preset invention, alternatives within the inventive concept as defined in the appending claims will be obvious to those skilled in the Art.

What we claim is:

1. A hydraulically operated drive system, comprising:

a first hydraulic closed-loop circuit including an equal displacement cylinder means including a pair of opposite fluid ports and an output means, a first pump of the variable displacement, reversible flow type, having a pair of opposite fluid ports and an input shaft, and a first pair of fluid lines connecting the ports of the cylinder means and of the first pump so as to form said closed-loop circuit;

a second closed loop hydraulic circuit including second and third pumps each having a pair of opposite fluid ports and an input/output shaft, said second and third pumps being pump/motor means, and at least one of said second and third pumps being of the variable displacement type, and a second pair of fluid lines connecting the ports of the second and third pumps so as to form said second closed-loop;

a prime mover having an output shaft means;

a drive connecting means for connecting the output shaft of said prime mover to said input shaft of said first pump and to the input/output shaft of said second pump and connecting said input/output shaft of said second pump to the input shaft of said first pump, a flywheel drivingly connected with said input/output shaft of said third pump for receiving rotating device therefrom and for transmitting driving power thereto; and control means for establishing i) a setting of said first pump to control the quantity and directing of flow of fluid in said first circuit to thereby determine the direction and velocity of travel of said output means of said cylinder means; and ii) the setting of displacement within said at least one of said second or third pumps to thereby establish the function of said second pump/motor as a motor or a pump.

2. A drive system as defined in claim 1 wherein said first pump is a pump/motor means, said input shaft of said pump/motor means is included in a first pump input/output shaft, and said drive connecting means includes means for drivingly connecting said first pump input/output shaft to said input/output shaft of said second pump for establishing drive of said first pump by said second pump when said second pump functions as a motor and said first pump functions as a pump, and alternatively for establishing drive of said second pump by said first pump as said first pump functions as a motor and said second pump functions as a pump.

3. A drive system as defined in claim 2 wherein control means is a central main controller, and said first variable displacement reversible flow pump includes a control unit; and further including signal transmitting means for providing a signal to said main controller unit from said controller to operate through a cycle consisting alternatively as a pump and as a motor to effect travel in opposite directions of said output means of said cylinder means.

4. A drive system as defined in claim 3 wherein said second pump is of the variable displacement type having a control unit; and including signal transmitting means for providing a signal to the second pump control unit from said main controller to vary the setting of displacement of said second pump to function in said second circuit as a pump whereby said third pump is driven as a motor when said first pump has been set to function as a motor.

5. A drive system as defined in claim 1, wherein said drive system is arranged to drive a pump jack device, and includes means for connection of said output means of said cylinder means to a polished rod at a well head, whereby a velocity of said output means through repeated pumping cycles each consisting of a direction of travel in an uplift stroke and a direction of travel in a down-stroke is transferred to said polish rod.

6. A drive system as defined in claim 5, wherein said first pump has a control unit, and said control means is a central main controller; and further comprising signal transmitting means for providing a signal to said control unit, the provided signals from said controller to said control unit setting said first pump to pump fluid in said first circuit in one direction to provide a lifting force of an instantaneous magnitude for establishing a predetermined velocity profile and distance of travel for the polished rod during the uplift stroke.

7. A drive system as defined in claim 6, wherein said first pump is a pump/motor means, said controller providing signals to said control unit of salad first pump to set said first pump to function as a motor for instantaneously limiting the rate of flow of the fluid in an opposite direction in said first circuit to thereby establish a predetermined velocity profile and distance of travel for the polished rod during the down stroke.

8. A drive system as defined in claim 7, wherein said input shaft of first pump is included in a first input/output shaft, and said drive connecting means includes means for drivingly connecting said first pump input/output shaft of said first pump to said input/output shaft of said second pump for permitting driving of said first pump by said prime mover and said second pump during said uplift stroke.

9. A drive system as defined in claim 8, wherein said second pump is of the variable displacement type having a control unit; and further comprising signal transmitting means for providing the second pump control unit with a signal for varying the setting of the displacement of said second pump to function as a pump during said down stroke of said polished rod whereby said second pump is driven by said first pump.

10. A drive system as defined in claim 9, Wherein said drive connecting means provides drive from said prime mover to said second pump during said downstroke.

11. A drive system as defined in claim 10, wherein said third pump functions as a motor during said downstroke to thereby increase the speed of said flywheel.

12. A drive system as defined in claim 10, wherein said signals provided to said control unit of said first pump are computed by said main controller from parameters including programmed information for establishing a predetermined velocity profile throughout the pumping cycle of said polished rod.

13. A drive system as defined in claim 12, wherein said system includes sensors for providing said main controller with parameters for use in conjunction with said programmed information to produce said signals for transmittal to said control unit of said first pump.

14. A drive system as defined in claim 13, wherein said sensors include means for determining instantaneous readings representative of relative pressure values in said fluid lines of said first circuit, the direction of travel of said output means and the position of said output means along its total length of travel.

15. A drive system as defined in claim 14, wherein said sensors include means for determining instantaneous readings representative of the velocity of travel of the output means.

16. A drive system as defined in claim 12 wherein parameters included within said programmed information of said main controller includes a parameter representative of a maximum permissible output power of said prime mover.

17. A drive system as defined in claim 12 wherein said programmed information includes a parameter representing a maximum permissible load on said polished rod.

18. A drive system as defined in claim 13, wherein said system includes sensors for providing said main controller with parameters for use in conjunction with said information to produce said signals for transmission to said control unit of said second pump.

19. A drive system as defined in claim 18, wherein said sensors include means for determining readings representative of instantaneous relative pressure values in said fluid lines of said second circuit.

20. A drive system as defined in claim 19, wherein said sensors include means for determining instantaneous readings representative of a rotational speed of said flywheel.

21. A drive system as defined in claim 1, wherein said cylinder means includes a vertical disposed cylinder including a throughrod integral with a piston within said piston, said through rod extending through opposite ends of said cylinder and being fixed to stationary means at opposite ends, said pair of fluid lines being connected to internal passages within said rod and terminating at ports disposed on opposite sides of said piston, said output means being connected to said cylinder.

22. A drive system as defined in claim 21, and including an additional cylinder of the same type connected in parallel, said output means including a crossbar connected between said cylinders.

23. A drive system as defined in claim 1, wherein said cylinder means includes a pair of stationary cylinders, each cylinder having a piston disposed therein and dividing said cylinder into upper and lower cylinder chambers, said ports of said cylinder means being in communication one each with said chambers, said upper cylinder chamber being subjected to a higher pressure during a downstroke of said output means, and said lower cylinder chamber being subject to a higher pressure during an upstroke of said piston, a piston red in the form of through rod having an upper portion extending through a top end of said cylinder and a bottom portion extending through a bottom end of said cylinder to achieve equal displacement at opposite ends of said cylinder, said output means including a crossbar attached between upper ends of the upper portions of the piston rods, said upper portion of each piston rod being hollow to define an inner chamber, and valve means placing said inner chamber in communication alternatively between said upper and lower cylinder chambers, depending on which chamber is experiencing a higher fluid pressure.

24. A drive system as defined in claim 23, wherein said valve means include a shuttle valve having a central chamber, a pair of passages one each connecting said upper and lower cylinder chambers to ports in said central chambers, a passage extending from said central chamber to said inner chamber of the upper portion of the piston rod, a valve member in said central chamber movable under the influence of fluid pressures in the cylinder chambers for closing the port of the passage in communication with the chamber of lower pressure while exposing the central chamber to the pressure of higher pressure whereby said inner chamber of said upper portion is exposed to the higher pressure via the passage between said central chamber and said inner chamber.

* * * * *